US007810806B2

(12) United States Patent
Takasaka et al.

(10) Patent No.: US 7,810,806 B2
(45) Date of Patent: Oct. 12, 2010

(54) PAPER FEED MECHANISM AND IMAGE GENERATING APPARATUS WITH REVERSELY DRIVEN FEED ROLLER

(75) Inventors: Daisuke Takasaka, Daito (JP); Takahiro Naito, Daito (JP)

(73) Assignee: Funai Electric Co., Ltd., Daito-shi (JP)

( * ) Notice: Subject to any disclaimer, the term of this patent is extended or adjusted under 35 U.S.C. 154(b) by 254 days.

(21) Appl. No.: 12/140,690

(22) Filed: Jun. 17, 2008

(65) Prior Publication Data

US 2008/0315500 A1 Dec. 25, 2008

(30) Foreign Application Priority Data

Jun. 20, 2007 (JP) ..... 2007-161983

(51) Int. Cl.
*B65H 9/10* (2006.01)

(52) U.S. Cl. ..... 271/233; 271/109; 271/145; 271/902

(58) Field of Classification Search ..... 271/233, 271/902, 10.12, 109, 226, 145, 37, 227, 241; 270/58.12, 58.16, 58.17, 58.27
See application file for complete search history.

(56) References Cited

U.S. PATENT DOCUMENTS 5,651,540 A * 7/1997 Watanabe et al. ..... 271/10.12
6,398,070 B1 6/2002 Uchida
6,698,744 B2 * 3/2004 Yamada et al. ..... 270/58.12
7,644,920 B2 * 1/2010 Takasaka et al. ..... 271/250

FOREIGN PATENT DOCUMENTS

| | | | |
|---|---|---|---|
| JP | 8-175696 | A | 7/1996 |
| JP | 10-218383 | A | 8/1998 |
| JP | 10-279088 | A | 10/1998 |
| JP | 11-29236 | A | 2/1999 |
| JP | 3152221 | B2 | 1/2001 |
| JP | 2001-80763 | A | 3/2001 |
| JP | 2005-298144 | A | 10/2005 |

OTHER PUBLICATIONS

Japanese Office Action dated Apr. 14, 2009 including English translation (Five (5) pages).

* cited by examiner

*Primary Examiner*—Richard W Ridley
*Assistant Examiner*—Jeremy Severson
(74) *Attorney, Agent, or Firm*—Crowell & Moring LLP

(57) ABSTRACT

This paper feed mechanism includes a paper feed cassette integrally having a paper contact portion on a position deviating from the center of a rear-side inner wall surface in the cross direction by a prescribed distance in the cross direction and an apparatus body mountable with the paper feed cassette, and the apparatus body includes a driving portion rotating a paper feed roller in a paper feed direction and a paper discharge direction and a control portion bringing the rear end of the paper into contact with the paper contact portion for generating torque for the paper and thereafter transporting the paper to the apparatus body in paper feeding.

18 Claims, 9 Drawing Sheets

PAPER FEED MECHANISM AND IMAGE GENERATING APPARATUS WITH REVERSELY DRIVEN FEED ROLLER

BACKGROUND OF THE INVENTION

1. Field of the Invention

The present invention relates to a paper feed mechanism and an image generating apparatus, and more particularly, it relates to a paper feed mechanism and an image generating apparatus each comprising a paper feed cassette and an apparatus body mountable with the paper feed cassette.

2. Description of the Background Art

A paper feed mechanism comprising a paper feed cassette and an apparatus body mountable with the paper feed cassette is known in general, as disclosed in each of Japanese Patent Laying-Open Nos. 8-175696 (1996), 11-29236 (1999), 2001-80763 and 2005-298144 and Japanese Patent No. 3152221, for example.

A paper feeder according to the aforementioned Japanese Patent Laying-Open No. 8-175696 comprises a sheet receiving portion provided parallel to a direction for feeding sheets and a pair of side fences supporting both side surfaces of the sheets. The positions of the pair of side fences can be so controlled that the side fences come into contact with both side surfaces of the sheets. The sheets can be fed to the apparatus body in an unskewed (uninclined) manner by controlling the positions of the pair of side fences so that the side fences come into contact with both side surfaces of the sheets.

The aforementioned Japanese Patent Laying-Open No. 11-29236 discloses a paper feeder (paper feed mechanism) including a pair of tension rollers downwardly pressing transfer papers in paper feeding for inhibiting the transfer papers from movement resulting from paper feeding. The tension rollers downwardly press the transfer papers by the own weights thereof and are provided with high-friction members on portions coming into contact with the transfer papers, thereby applying a load to the transfer papers. Consequently, the load applied to the transfer papers causes back tension when the transfer papers are fed to the apparatus body, thereby correcting skew of the transfer papers.

The aforementioned Japanese Patent Laying-Open No. 2001-80763 discloses an automatic paper feeder (paper feed mechanism) comprising a paper feed roller transporting originals, a paper feed shaft forming the rotating shaft of the paper feed roller and two swing shutters including torque limiters limitedly transmitting the torque of the paper feed shaft. In this automatic paper feeder according to Japanese Patent Laying-Open No. 2001-80763, the two swing shutters push back standby originals until the uppermost original is completely transported, thereby suppressing the standby originals.

In a paper feed mechanism of a liquid injector according to the aforementioned Japanese Patent Laying-Open No. 2005-298144, a receiving portion receiving printed objects includes a paper feed tray lifted up when feeding the printed objects, a reference guide formed parallel to the direction for transporting the printed objects for supporting first side surfaces of the printed objects and an edge guide formed parallel to the reference guide for supporting second side surfaces of the printed objects while remaining unmoved also when feeding the printed objects, and the edge guide is provided with an urging portion having a spring on the base thereof for coming into contact with the second side surfaces of the printed objects on an end closer to the liquid injector. When the printed objects are transported, the paper feed tray is so lifted up that the urging portion presses the printed objects toward the reference guide, whereby the printed objects are transported parallelly to the reference guide. Thus, the printed objects are fed in an unskewed manner.

An automatic paper feeder (paper feed mechanism) according to the aforementioned Japanese Patent No. 3152221 comprises an original set table, a main roller transporting the uppermost original placed on the original set table, a return roller rotating oppositely to the main roller for preventing the main roller from convoluting originals subsequent to the uppermost original and a correction roller coaxial with the return roller for rotating in the same direction as the main roller at a higher transport speed than the main roller. The original set table includes an original butt surface parallel to the direction for transporting the originals on a first side surface thereof, while the main roller, the return roller and the correction roller are arranged closer to the original butt surface than the center of the original set table. While the originals subsequent to the uppermost original are gripped by the return roller, transported oppositely to the direction for transporting the originals and supplied with torque by the return roller to separate from the original butt surface in feeding, the correction roller rotating at the higher speed than the return roller urges the originals toward the original butt surface, thereby aligning the originals parallelly to the original butt surface. Thus, the originals are fed in an unskewed (uninclined) manner.

In the paper feeder described in the aforementioned Japanese Patent Laying-Open No. 8-175696, however, the sheet receiving portion must be separately provided with the pair of side fences movable perpendicularly to the direction for transporting the sheets in order to prevent skew (inclination) of the sheets, and hence the number of components is disadvantageously increased.

In the paper feeder described in the aforementioned Japanese Patent Laying-Open No. 11-29236, the pair of tension rollers including the high-friction members on the portions coming into contact with the transfer papers must be separately provided in order to suppress skew (inclination) of the transfer papers, and hence the number of components is disadvantageously increased.

In the automatic paper feeder described in the aforementioned Japanese Patent Laying-Open No. 2001-80763, the two swing shutters including the torque limiters in shaft holes must be separately provided in order to suppress skew (inclination) of the originals, and hence the number of components is disadvantageously increased.

In the liquid injector described in the aforementioned Japanese Patent Laying-Open No. 2005-298144, the urging portion having the spring on the base thereof must be separately provided in order to suppress skew (inclination) of the printed objects, and hence the number of components is disadvantageously increased.

In the automatic paper feeder described in the aforementioned Japanese Patent No. 3152221, the return roller rotating oppositely to the main roller and the correction roller rotating in the same direction as the main roller must be separately provided in order to suppress skew (inclination) of the originals, and hence the number of components is disadvantageously increased.

SUMMARY OF THE INVENTION

The present invention has been proposed in order to solve the aforementioned problems, and an object of the present invention is to provide a paper feed mechanism capable of suppressing inclination (skew) of a fed paper while suppressing increase in the number of components.

A paper feed mechanism according to a first aspect of the present invention comprises a paper feed cassette storing a paper and an apparatus body mountable with the paper feed cassette, while the apparatus body includes a paper feed roller, a driving portion rotating the paper feed roller in a first direction for feeding the paper and a second direction opposite to the first direction and a control portion controlling the driving portion, the paper feed cassette includes a paper storage portion receiving the paper, the paper storage portion has a paper contact portion integrally formed on a position of a rear-side inner wall surface deviating from the center in the cross direction of the paper by a prescribed distance in the cross direction of the paper, and the control portion is so formed as to control the driving portion for transporting the paper in the second direction with the paper feed roller, bringing the rear end of the paper into contact with the paper contact portion thereby generating torque for the paper, and thereafter transporting the paper in the first direction with the paper feed roller in paper feeding.

In the paper feed mechanism according to the first aspect, as hereinabove described, the paper contact portion is formed on the position of the rear-side inner wall surface of the paper storage portion deviating from the center in the cross direction of the paper by the prescribed distance in the cross direction of the paper while the paper feed roller transports the paper in the second direction opposite to the first direction for feeding the paper for bringing the rear end of the paper into contact with the paper contact portion thereby generating the torque for the paper around the paper contact portion and thereafter transporting the paper in the first direction so that the paper is fed after the same is urged toward an inner side surface substantially parallel to the first direction due to the torque applied thereto, whereby the paper can be fed to the apparatus body in an unskewed (uninclined) manner. Further, the paper contact portion is integrally formed on the rear-side inner wall surface of the paper storage portion, whereby skew of the paper can be suppressed without increasing the number of components.

In the aforementioned paper feed mechanism according to the first aspect, the paper contact portion of the paper feed cassette preferably includes a rib portion so formed as to protrude from the rear-side inner wall surface of the paper storage portion toward the rear end of the paper. According to this structure, the torque for the paper can be easily generated by bringing the rear end of the paper into contact with the rib portion.

In the aforementioned paper feed mechanism according to the first aspect, the paper feed cassette preferably further includes a regulating portion provided on a second inner side surface of the paper storage portion opposed to a first inner side surface of the paper storage portion substantially parallelly to the first direction for regulating a first side surface of the paper, and the paper contact portion is preferably arranged closer to the first inner side surface of the paper storage portion with respect to the center of the rear-side inner wall surface in the cross direction of the paper. According to this structure, the first side surface of the paper is urged toward the regulating portion so that the regulating portion regulates the cross-directional position of the paper when the paper is transported in the second direction and supplied with the torque around the paper contact portion, whereby skew of the paper can be easily suppressed.

In this case, the paper contact portion of the paper feed cassette is preferably arranged on the rear-side inner wall surface in the vicinity of a corner constituted of the rear end and the first inner side surface of the paper storage portion. According to this structure, the paper is transported in the second direction and brought into contact with the paper contact portion so that a larger radius of rotation can be ensured when the torque is supplied to the paper, whereby the paper can be more strongly urged toward the regulating portion. Consequently, skew of the fed paper can be more reliably suppressed in paper feeding.

In the aforementioned paper feed mechanism provided with the paper feed cassette including the regulating portion, a plurality of regulating portions are preferably provided on the paper feed cassette to protrude from the second inner side surface toward the first inner side surface of the paper storage portion and integrally formed on the second inner side surface of the paper storage portion. According to this structure, frictional force applied to the first side surface of the paper can be reduced as compared with a case where only one regulating portion is provided to extend from the second inner side surface of the paper storage portion due to the plurality of regulating portions when the paper is transported while the first side surface thereof is in contact with the regulating portions, whereby the paper can be more smoothly transported. Further, the regulating portions are so integrally provided on the second inner side surface of the paper storage portion that increase in the number of components can be suppressed as compared with a case where the regulating portions are provided independently of the paper storage portion.

In the aforementioned paper feed mechanism according to the first aspect, the paper feed cassette preferably further includes a pressing portion integrally formed on the first inner side surface of the paper storage portion for pressing a second side surface of the paper thereby urging the paper toward a second inner side surface of the paper feed cassette when the paper feed cassette stores the paper. According to this structure, the pressing portion can urge the paper toward the regulating portion of the paper storage portion by pressing the second side surface of the paper when the paper feed cassette stores the paper, whereby the effect of suppressing skew of the paper can be more improved. Further, the pressing portion is so integrally formed on the first inner side surface of the paper storage portion that increase in the number of components can be suppressed despite the pressing portion.

In this case, the pressing portion of the paper feed cassette is preferably switched between a pressing state pressing the second side surface of the paper and a nonpressing state not pressing the second side surface of the paper, and switched to the pressing state when the paper is transported in the second direction. According to this structure, the pressing portion reliably urges the paper toward the regulating portion of the paper storage portion when the paper is transported in the second direction, whereby the effect of suppressing skew of the paper can be easily improved.

In the aforementioned paper feed mechanism according to the first aspect, the paper contact portion of the paper feed cassette is preferably so formed as to extend from the lower end to the upper end of the rear-side inner wall surface of the paper storage portion. According to this structure, the paper transported in the second direction can be brought into contact with the paper contact portion regardless of the vertical position of the transported paper, whereby skew of the paper can be more reliably suppressed.

In the aforementioned paper feed mechanism according to the first aspect, a surface of the paper contact portion of the paper feed cassette coming into contact with the paper is preferably rounded. According to this structure, the paper transported in the second direction is rotated in contact with the rounded surface of the paper contact portion, whereby the paper can be more smoothly rotated.

An image generating apparatus according to a second aspect of the present invention comprises a paper feed cassette storing a paper and an apparatus body, mountable with the paper feed cassette, including a print portion, while the apparatus body includes a paper feed roller, a driving portion rotating the paper feed roller in a first direction for feeding the paper and a second direction opposite to the first direction and a control portion controlling the driving portion, the paper feed cassette includes a paper storage portion receiving the paper, the paper storage portion has a paper contact portion integrally formed on a position of a rear-side inner wall surface deviating from the center in the cross direction of the paper by a prescribed distance in the cross direction of the paper, and the control portion is so formed as to control the driving portion for transporting the paper in the second direction with the paper feed roller, bringing the rear end of the paper into contact with the paper contact portion thereby generating torque for the paper, and thereafter transporting the paper in the first direction with the paper feed roller in paper feeding.

In the image generating apparatus according to the second aspect, as hereinabove described, the paper contact portion is formed on the position of the rear-side inner wall surface of the paper storage portion deviating from the center in the cross direction of the paper by the prescribed distance in the cross direction of the paper while the paper feed roller transports the paper in the second direction opposite to the first direction for feeding the paper for bringing the rear end of the paper into contact with the paper contact portion thereby generating the torque for the paper around the paper contact portion and thereafter transporting the paper in the first direction so that the paper is fed after the same is urged toward an inner side surface substantially parallel to the first direction due to the torque applied thereto, whereby the paper can be fed to the apparatus body in an unskewed (uninclined) manner. Further, the paper contact portion is integrally formed on the rear-side inner wall surface of the paper storage portion, whereby skew of the paper can be suppressed without increasing the number of components.

In the aforementioned image generating apparatus according to the second aspect, the paper contact portion of the paper feed cassette preferably includes a rib portion so formed as to protrude from the rear-side inner wall surface of the paper storage portion toward the rear end of the paper. According to this structure, the torque for the paper can be easily generated by bringing the rear end of the paper into contact with the rib portion.

In the aforementioned image generating apparatus according to the second aspect, the paper feed cassette preferably further includes a regulating portion provided on a second inner side surface of the paper storage portion opposed to a first inner side surface of the paper storage portion substantially parallelly to the first direction for regulating a first side surface of the paper, and the paper contact portion is preferably arranged closer to the first inner side surface of the paper storage portion with respect to the center of the rear-side inner wall surface in the cross direction of the paper. According to this structure, the first side surface of the paper is urged toward the regulating portion so that the regulating portion regulates the cross-directional position of the paper when the paper is transported in the second direction and supplied with the torque around the paper contact portion, whereby skew of the paper can be easily suppressed.

In this case, the paper contact portion of the paper feed cassette is preferably arranged on the rear-side inner wall surface in the vicinity of a corner constituted of the rear end and the first inner side surface of the paper storage portion. According to this structure, the paper is transported in the second direction and brought into contact with the paper contact portion so that a larger radius of rotation can be ensured when the torque is supplied to the paper, whereby the paper can be more strongly urged toward the regulating portion. Consequently, skew of the fed paper can be more reliably suppressed in paper feeding.

In the aforementioned image generating apparatus provided with the paper feed cassette including the regulating portion, a plurality of regulating portions are preferably provided on the paper feed cassette to protrude from the second inner side surface toward the first inner side surface of the paper storage portion and integrally formed on the second inner side surface of the paper storage portion. According to this structure, frictional force applied to the first side surface of the paper can be reduced as compared with a case where only one regulating portion is provided to extend from the second inner side surface of the paper storage portion due to the plurality of regulating portions when the paper is transported while the first side surface thereof is in contact with the regulating portions, whereby the paper can be more smoothly transported. Further, the regulating portions are so integrally provided on the second inner side surface of the paper storage portion that increase in the number of components can be suppressed as compared with a case where the regulating portions are provided independently of the paper storage portion.

In the aforementioned image generating apparatus according to the second aspect, the paper feed cassette preferably further includes a pressing portion integrally formed on the first inner side surface of the paper storage portion for pressing a second side surface of the paper thereby urging the paper toward a second inner side surface of the paper feed cassette when the paper feed cassette stores the paper. According to this structure, the pressing portion can urge the paper toward the regulating portion of the paper storage portion by pressing the second side surface of the paper when the paper feed cassette stores the paper, whereby the effect of suppressing skew of the paper can be more improved. Further, the pressing portion is so integrally formed on the first inner side surface of the paper storage portion that increase in the number of components can be suppressed despite the pressing portion.

In this case, the pressing portion of the paper feed cassette is preferably switched between a pressing state pressing the second side surface of the paper and a nonpressing state not pressing the second side surface of the paper, and switched to the pressing state when the paper is transported in the second direction. According to this structure, the pressing portion reliably urges the paper toward the regulating portion of the paper storage portion when the paper is transported in the second direction, whereby the effect of suppressing skew of the paper can be easily improved.

In the aforementioned image generating apparatus according to the second aspect, the paper contact portion of the paper feed cassette is preferably so formed as to extend from the lower end to the upper end of the rear-side inner wall surface of the paper storage portion. According to this structure, the paper transported in the second direction can be brought into contact with the paper contact portion regardless of the vertical position of the transported paper, whereby skew of the paper can be more reliably suppressed.

In the aforementioned image generating apparatus according to the second aspect, a surface of the paper contact portion of the paper feed cassette coming into contact with the paper is preferably rounded. According to this structure, the paper transported in the second direction is rotated in contact with the rounded surface of the paper contact portion, whereby the paper can be more smoothly rotated.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

An embodiment of the present invention is now described with reference to the drawings.

First, the structure of a sublimatic printer 10 comprising a paper feed mechanism according to the embodiment of the present invention is described with reference to FIGS. 1 to 9. This embodiment of the present invention is applied to the sublimatic printer 10 employed as an exemplary image generating apparatus.

Figure 1:
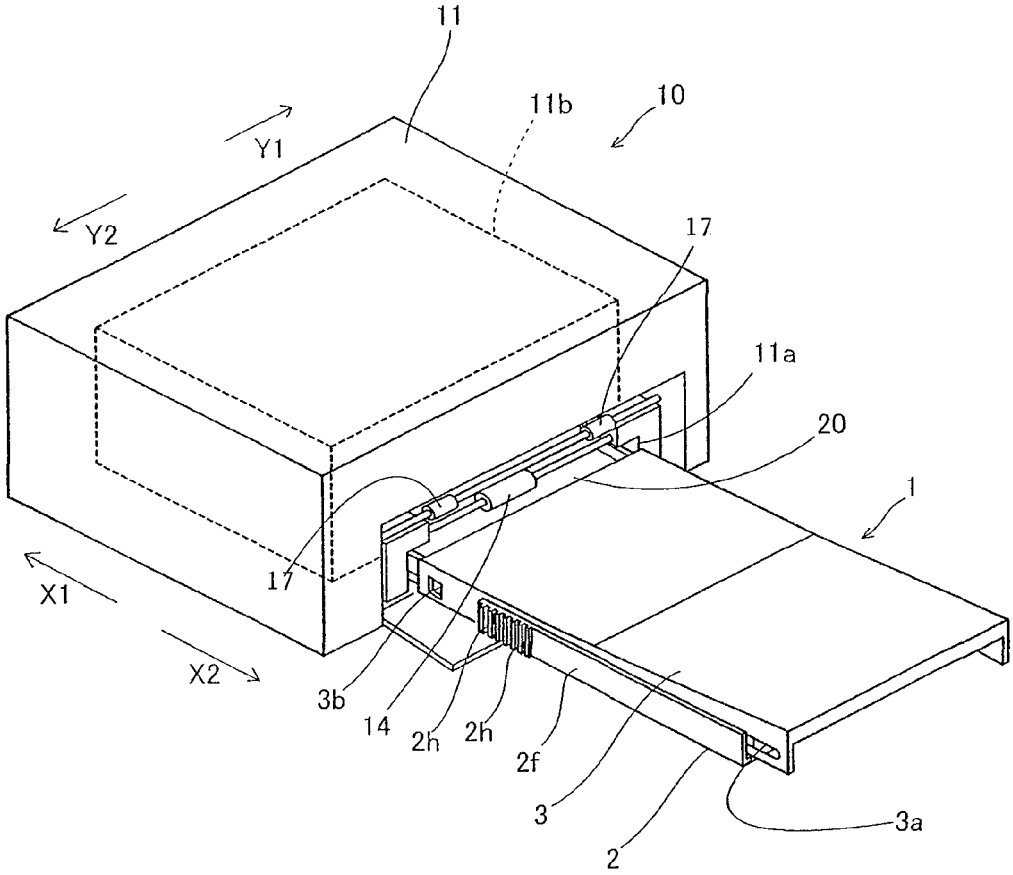
FIG. 1 is a perspective view showing the overall structure of a paper feed cassette according to an embodiment of the present invention in a state mounted on a sublimatic printer.
Figure 2:
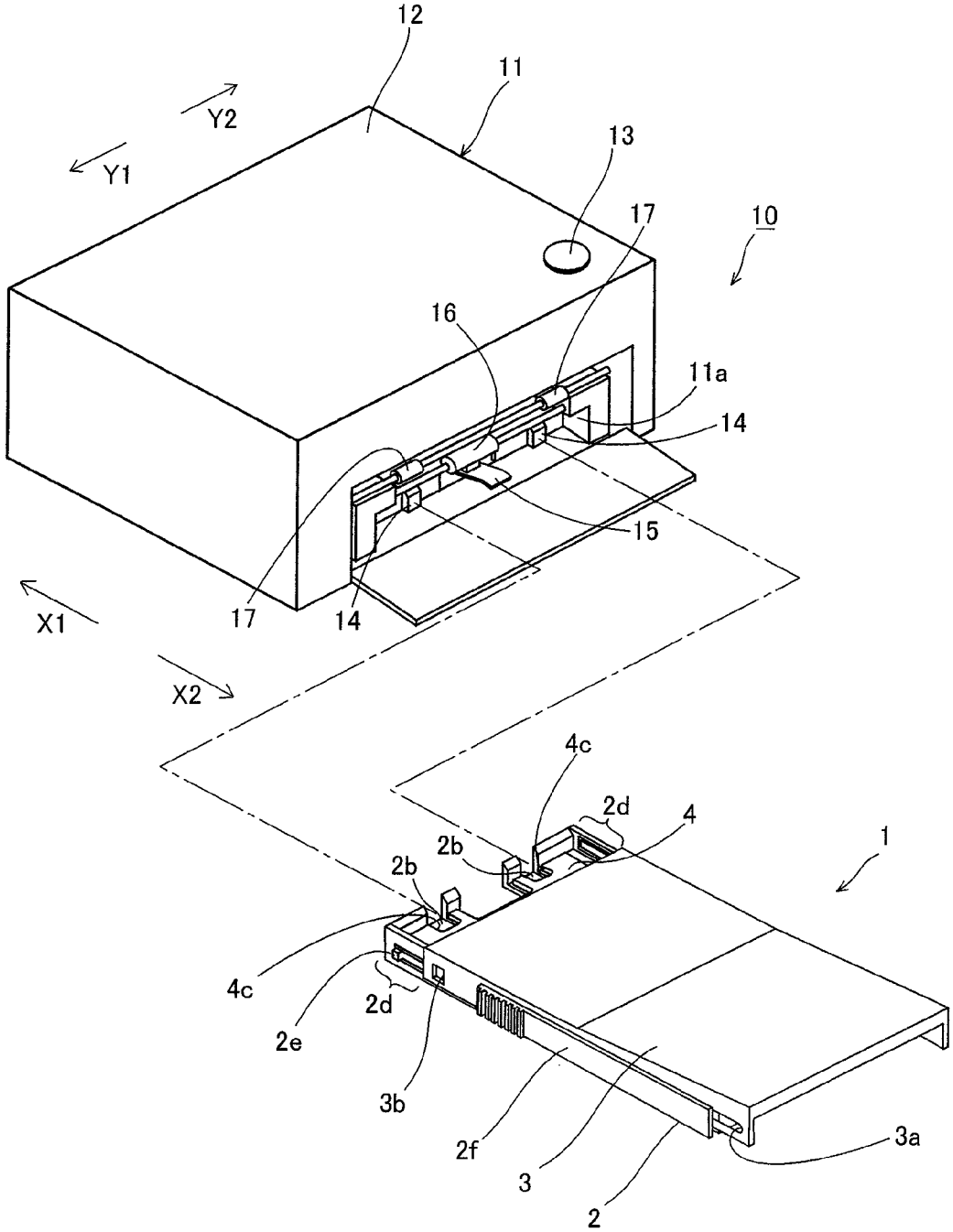
FIG. 2 is a perspective view showing the overall structure of the paper feed cassette according to the embodiment of the present invention in a state detached from the sublimatic printer.
Figure 3:
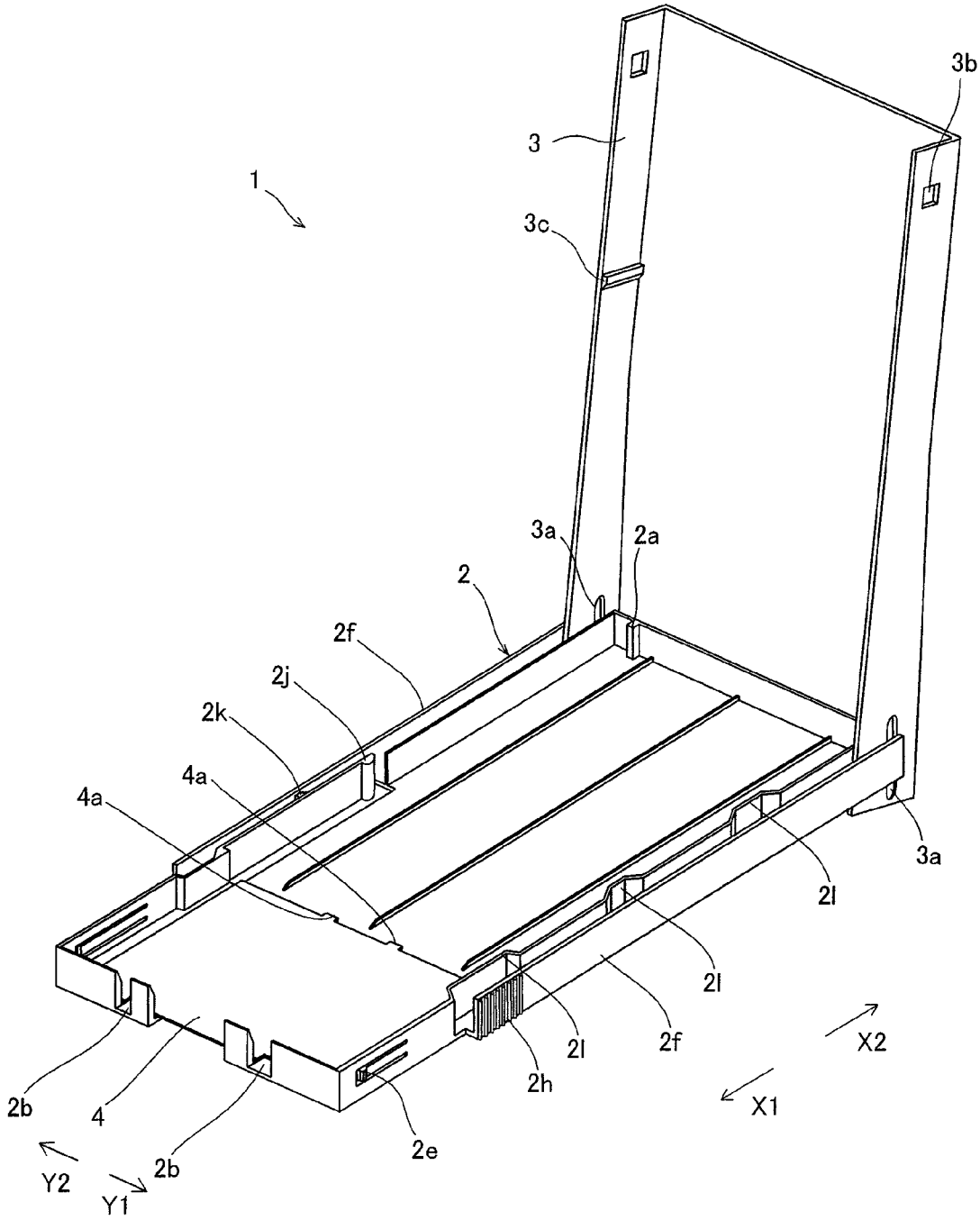
FIG. 3 is a perspective view showing a lid member of the paper feed cassette according to the embodiment shown in FIG. 1 in an open state with respect to a paper storage member.
Figure 4:
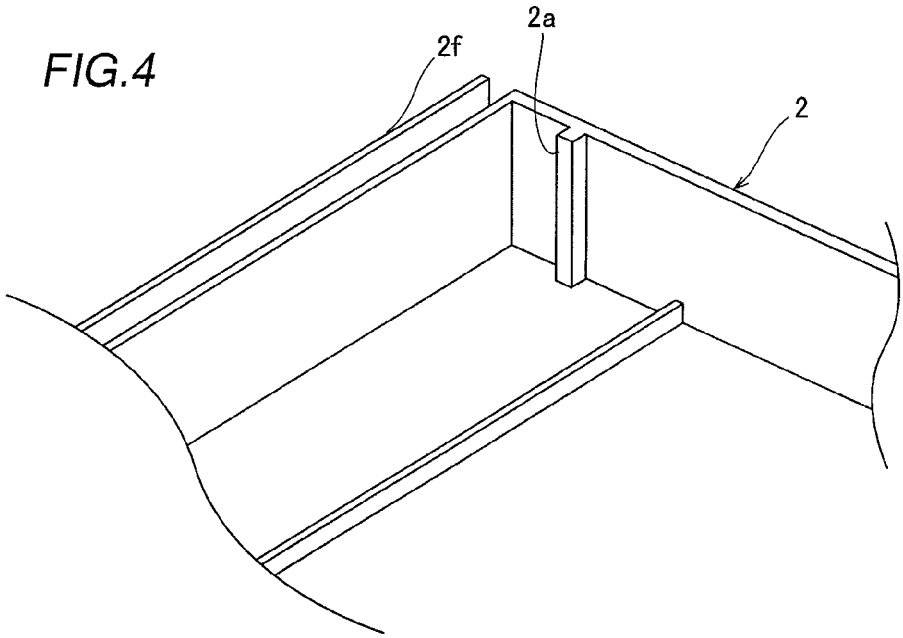
FIG. 4 is an enlarged perspective view of a portion around a rear-end rib of the paper feed cassette according to the embodiment shown in FIG. 3.
Figure 5:
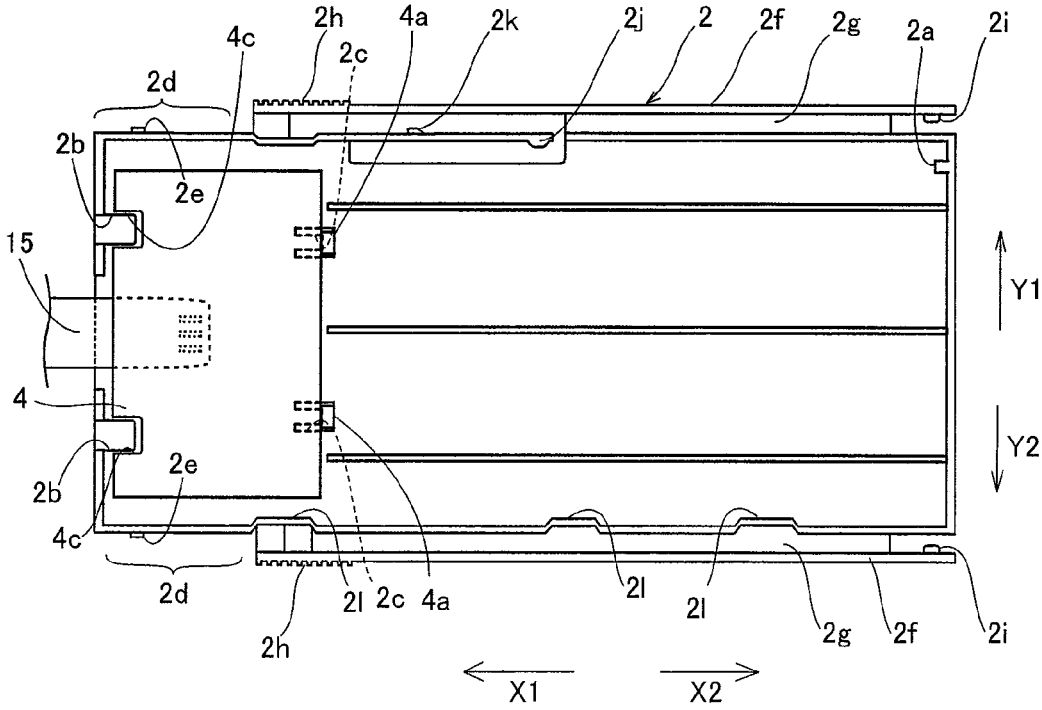
FIG. 5 is a plan view showing a paper tray of the paper feed cassette according to the embodiment shown in FIG. 1.

The sublimatic printer 10 according to the embodiment of the present invention comprises a paper feed cassette 1 detachably mounted on a paper feed port 11*a* of a printer body 11, as shown in FIGS. 1 and 2. This paper feed cassette 1 includes a paper tray 2 of resin, an openable/closable lid member 3 and a paper push-up member 4, as shown in FIGS. 3 and 5. The paper tray 2 is an example of the "paper storage portion" in the present invention. The printer body 11 of the sublimatic printer 10 includes a housing 12 storing a print head 19 (see FIG. 8) described later therein, a power supply button 13 arranged on the upper surface of the housing 12, paper separating members 14 separating papers 40 (see FIG. 1) fed to the sublimatic printer 10 one by one from each other, a push-up lever 15 pushing up the paper push-up member 4 of the paper feed cassette 1, a paper feed roller 16 for transporting the papers 40 into the sublimatic printer 10 and two paper discharge rollers 17 discharging printed papers 40 from the sublimatic printer 10. The paper feed cassette 1, the paper separating members 14, the push-up lever 15 and the paper feed roller 16 constitute the paper feed mechanism of the sublimatic printer 10.

As shown in FIG. 2, the push-up lever 15 of the sublimatic printer 10 is so formed as to support the lower portion of the paper push-up member 4 when the paper feed cassette 1 is mounted on the printer body 11. This push-up lever 15 has a function of lifting up the paper push-up member 4 thereby bringing front portions (along arrow X1) of the papers 40 (see FIG. 1) arranged on the upper portion of the paper push-up member 4 into contact with the paper feed roller 16. The paper feed roller 16 is so formed as to rotate in a direction (along arrow X1) for transporting the papers 40 in contact with the paper feed roller 16 or in an opposite direction (along arrow X2) when the push-up lever 15 lifts up the paper push-up member 4.

The paper tray 2 of the paper feed cassette 1 is provided for storing the papers 40 fed to the sublimatic printer 10, as shown in FIG. 1. This paper tray 2 is substantially rectangularly formed in plan view. More specifically, the paper tray 2 includes a substantially rectangular bottom surface and side surfaces vertically upwardly extending from outer edge portions of the substantially rectangular bottom surface.

According to this embodiment, a rear-end rib 2*a* in the form of a rectangular parallelepiped is provided on a portion of the inner wall surface of the paper tray 2 along arrow X2 in the vicinity of a corner where the side surface of the paper tray 2 along arrow Y1 and the side surface along arrow X2 (rear side) intersect with each other, as shown in FIGS. 3 to 6. The rear-end rib 2*a* is an example of the "paper contact portion" or the "rib portion" in the present invention. More specifically, the rear-end rib 2*a* protrudes from the rear-side inner wall surface of the paper tray 2 toward rear ends of the papers 40, and is integrally formed on the rear-side inner wall surface of the paper tray 2. Further, the rear-end rib 2*a* is so formed as to extend from the lower end to the upper end of the inner wall surface including the rear-side inner wall surface of the paper tray 2. This rear-end rib 2*a* is so arranged that the papers 40 move in the direction (along arrow X2) opposite to the paper feed direction at the start of a paper feed operation and the rear ends of the papers 40 come into contact with the rear-end rib 2*a* so that the papers 40 are supplied with torque. This point is described later in detail.

As shown in FIGS. 2 and 5, a pair of recess portions 2*b* fitted with the paper separating members 14 (see FIG. 2) of the sublimatic printer 10 are formed on the end of the paper tray 2 along arrow X1. A pair of mounting holes 2*c* (see FIG. 5) are provided on portions of the paper tray 2 separated from the recess portions 2*b* along arrow X2, for engaging with engaging portions 4*a* (see FIG. 5) of the paper push-up member 4 described later.

Printer insert portions 2*d* inserted into the paper feed port 11*a* are provided on the side of the paper tray 2 along arrow X1, as shown in FIGS. 2 and 5. Outwardly protruding engaging sections 2*e* are provided on the outer side surfaces of the paper tray 2 along arrows Y1 and Y2 on portions corresponding to the printer insert portions 2*d* respectively. These engaging sections 2*e* engage with engaging portions (not shown) provided on the printer body 11 respectively while the pair of recess portions 2*b* provided on the bottom surface engage with the paper separating members 14 of the printer body 11 respectively, so that the paper feed cassette 1 can be detachably fixed to the paper feed port 11*a*.

Mounting portions 2*f* for mounting the lid member 3 are provided on the side surfaces of the paper tray 2 along arrows Y1 and Y2 respectively. These mounting portions 2*f* are opposed to the outer side surfaces (surfaces along arrows Y1 and Y2) of the paper tray 2 along arrows Y1 and Y2 respectively, at prescribed intervals from these outer side surfaces. The mounting portions 2*f* are coupled to the paper tray 2 by coupling portions 2*g* respectively. The mounting portions 2*f* along arrows Y1 and Y2 are provided on the surfaces along arrows Y1 and Y2 with corrugated grip portions 2*h* on the sides along arrow X1 respectively. The mounting portions 2*f* along arrows Y1 and Y2 are further provided on the surfaces along arrows Y2 and Y1 with shaft portions 2*i* engaging with slots 3*a* (see FIG. 5) of the lid member 3 described later on the sides along arrow X2 respectively.

According to this embodiment, a paper pressing portion 2*j* is integrally provided on the side surface of the paper tray 2 along arrow Y1, and a protrusive section 2*k* is provided on a surface of the paper pressing portion 2*f* opposed to the mounting portion 2*f* along arrow Y1. This protrusive section 2*k* is pressed by a pressing portion 3*c* of the lid member 3 described later along arrow Y2 to enter a pressing state, and enters a nonpressing state when the lid member 3 is not mounted on the paper tray 2. When the lid member 3 is mounted on the paper tray 2 as described later, the protrusive section 2*k* is so pressed along arrow Y2 that the paper pressing portion 2*j* moves along arrow Y2 and is switched from the nonpressing state to the pressing state. Thus, the paper pressing portion 2*j* can urge the papers 40 placed on the paper tray 2 toward the inner side surface (paper regulating portions 21) of the paper tray 2 along arrow Y2 in the paper feed operation, thereby inhibiting the papers 40 from moving in the paper tray 2 along arrows Y1 and Y2. The paper pressing portion 2*j* is an example of the "pressing portion" in the present invention.

Figure 6:
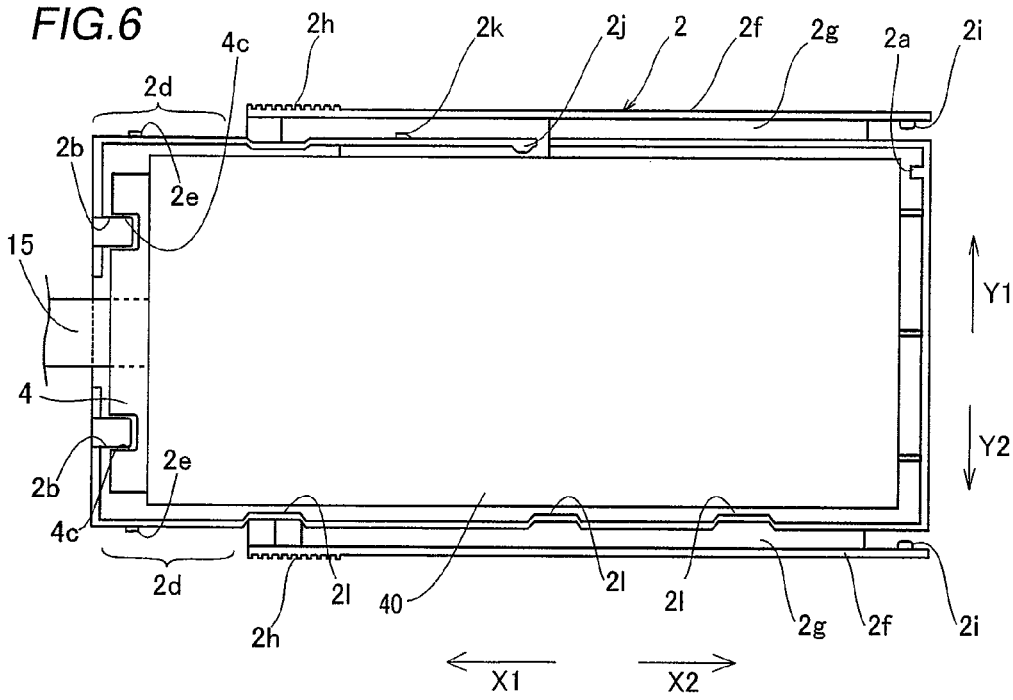
FIG. 6 is a plan view showing the paper tray of the paper feed cassette according to the embodiment shown in FIG. 1 in a state receiving papers.

According to this embodiment, three paper regulating portions 21 protruding from the inner wall surface of the paper tray 2 along arrow Y2 toward the direction along arrow Y1 are integrally provided on separate positions of the side surface of the paper tray 2 along arrow Y2 respectively, as shown in FIGS. 3, 5 and 6. The paper regulating portions 21 are provided parallel to the direction (along arrow X1) for feeding the papers 40, in order to regulate side surfaces of the papers 40 along arrow Y2. Thus, the positions of the papers 40 (see FIG. 6) placed on the paper tray 2 along arrows Y1 and Y2 can be regulated. The paper regulating portions 21 are examples of the "regulating portion" in the present invention.

Figure 7:
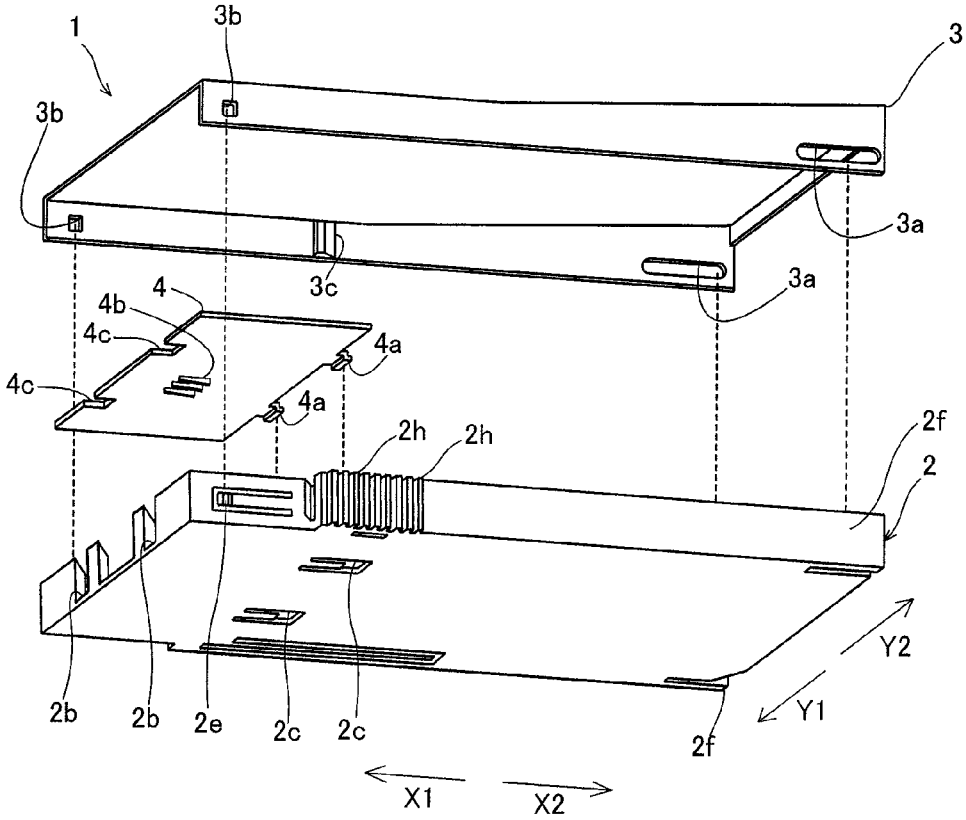
FIG. 7 is an exploded perspective view of the paper feed cassette according to the embodiment shown in FIG. 1.

The lid member 3 is mounted on the paper tray 2 in an openable/closable manner and so provided as to prevent the paper tray 2 from invasion of dust or the like, as shown in FIGS. 2 and 3. The lid member 3 has side surfaces perpendicular to the bottom surface of the paper tray 2 along arrows Y1 and Y2 respectively, as shown in FIG. 5. The lid member is provided on the side surfaces along arrows Y1 and Y2 with the slots 3*a* on the side along arrow X respectively, as shown in FIG. 7. The slots 3*a* are so formed as to extend along arrows X1 and X2 respectively, so that the shaft portions 2*i* are slidably mounted on the slots 3*a* along arrows X1 and X2 respectively. The lid member 3 is enabled to open the front portion (mounted on the printer body 11) of the paper feed cassette 1 when slid along arrow X2, as shown in FIG. 1. The lid member is further provided on the side surfaces along arrows Y1 and 2 with holes 3*b* on the side along arrow X1, for engaging with the engaging sections 2*e* of the paper feed cassette 1 when the paper feed cassette 1 is closed. The pressing portion 3*c* for pressing the protrusive section 2*k* of the paper pressing portion 2*j* is provided on the side surface of the lid member 3 along arrow Y1 opposed to the protrusive section 2*k* of the paper pressing portion 2*j*, as shown in FIGS. 3 and 7.

The engaging portions 4*a* rotatably engaging with the pair of mounting holes 2*c* of the paper feed cassette 1 are integrally formed on an end of the paper push-up member 4 along arrow X2, as shown in FIGS. 5 and 7. Three protrusions 4*b* are integrally formed on the back surface of the paper push-up member 4 for further pushing up the papers 40 (see FIG. 1) toward the surface of the paper feed cassette 1 opposed to the paper tray 2, as shown in FIG. 7. These protrusions 4*b* are formed on positions coming into contact with the push-up lever 15 (see FIG. 2) of the printer body 11. A pair of notches 4*c* corresponding to the recess portions 2*b* of the paper tray 2 are formed on an end of the paper push-up member 4 along arrow X1. The pair of notches 4*c* have functions of suppressing connection between the paper separating members 14 of the printer body 11 and the paper push-up member 4 when the paper feed cassette 1 is mounted on the printer body 11.

Figure 8:
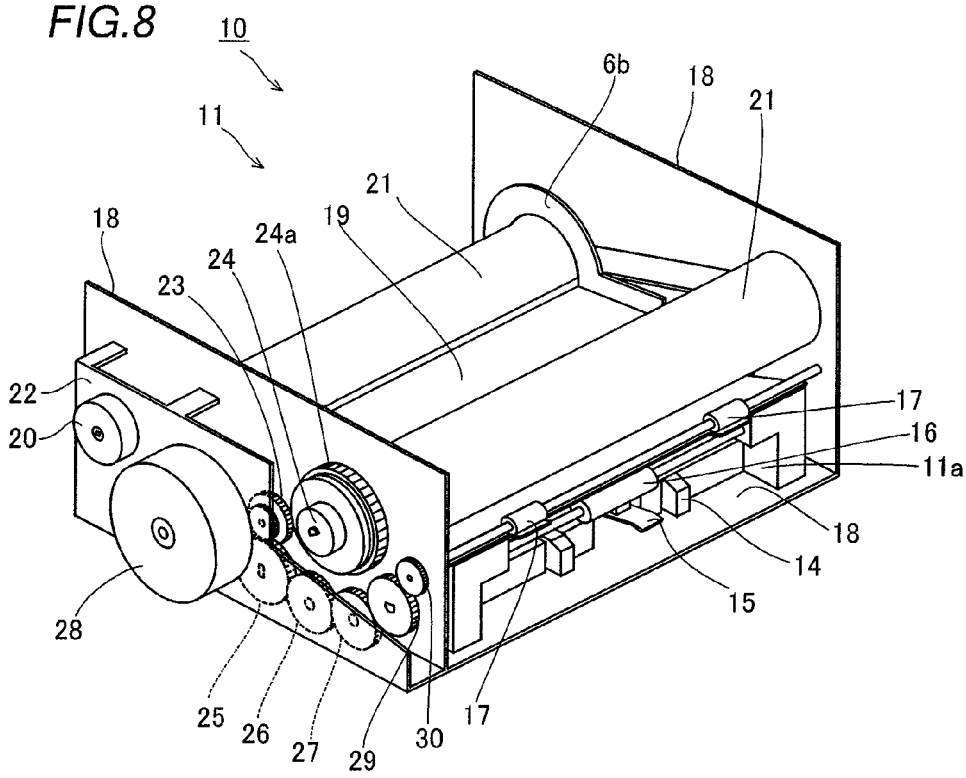
FIG. 8 is a perspective view of the sublimatic printer according to the embodiment shown in FIG. 1.

According to this embodiment, the printer body 11 of the sublimatic printer 10 further includes a chassis 18 of metal, a print head 19 for printing, a stepping motor 20 functioning as a driving source for rotating the print head 19, an ink sheet cassette 21 storing an ink sheet (not shown), a motor bracket 22 of sheet metal, a swingable swing gear 23, an ink sheet take-up reel 24 having a gear portion 24*a*, a feed roller gear 25 for rotating a feed roller (not shown) transporting the papers 40 (see FIG. 1) to the print head 19 and intermediate gears 26 and 27, as shown in FIG. 8.

Figure 9:
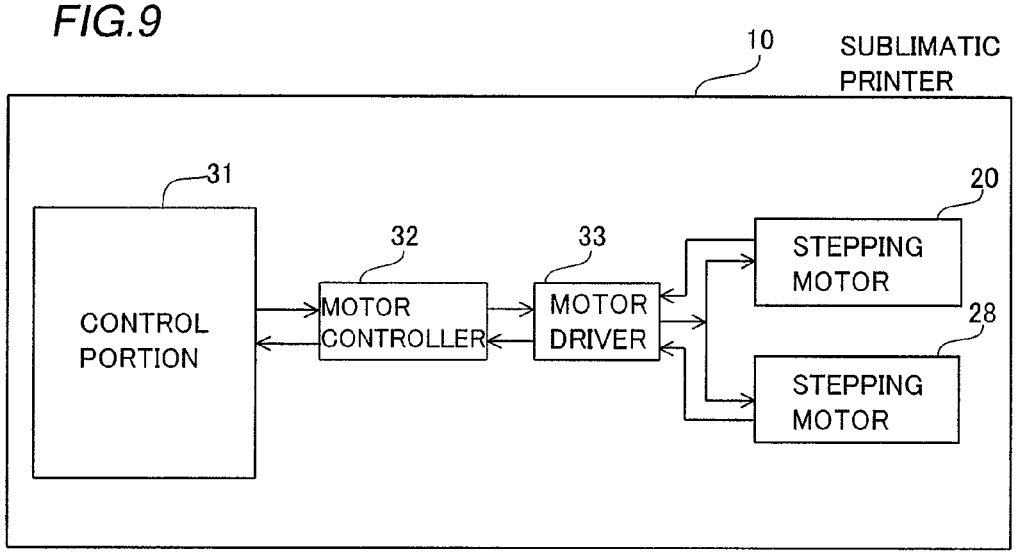
FIG. 9 is a block diagram showing the circuit structure of the sublimatic printer according to the embodiment shown in FIG. 1.

According to this embodiment, the printer body 11 further includes another stepping motor 28 having a function of feeding the papers 40 from the paper feed cassette 1 (see FIG. 1) mounted on the printer body 11 into the printer body 11 by rotating the paper feed roller 16 as a driving source, as shown in FIG. 9. The stepping motor 28 is an example of the "driving portion" in the present invention. The stepping motor 28 rotates the paper feed roller 16 through a paper feed roller gear 29 (see FIG. 8), thereby transporting the papers 40 in the paper feed direction (along arrow X1 (see FIG. 1)) and the direction (along arrow X2) opposite to the paper feed direction. Further, the stepping motor 28 discharges printed papers 40 by rotating the paper discharge rollers 17 through a paper discharge roller 30.

According to this embodiment, the sublimatic printer 10 further comprises a control portion 31 controlling a printing operation of the sublimatic printer 10, a motor controller 32 and a motor driver 33, as shown in FIG. 9. The motor controller 32 is provided for controlling rotational driving of the stepping motors 20 and 28 through the motor driver 33. The control portion 31 can control the stepping motor 28 to transport the papers 40 along arrow X1 (see FIG. 2) and along arrow X2.

The operation of the sublimatic printer 10 according to the embodiment of the present invention for feeding the papers 40 to the printer body 11 is described with reference to FIGS. 1, 8 and 10 to 13.

Figure 10:
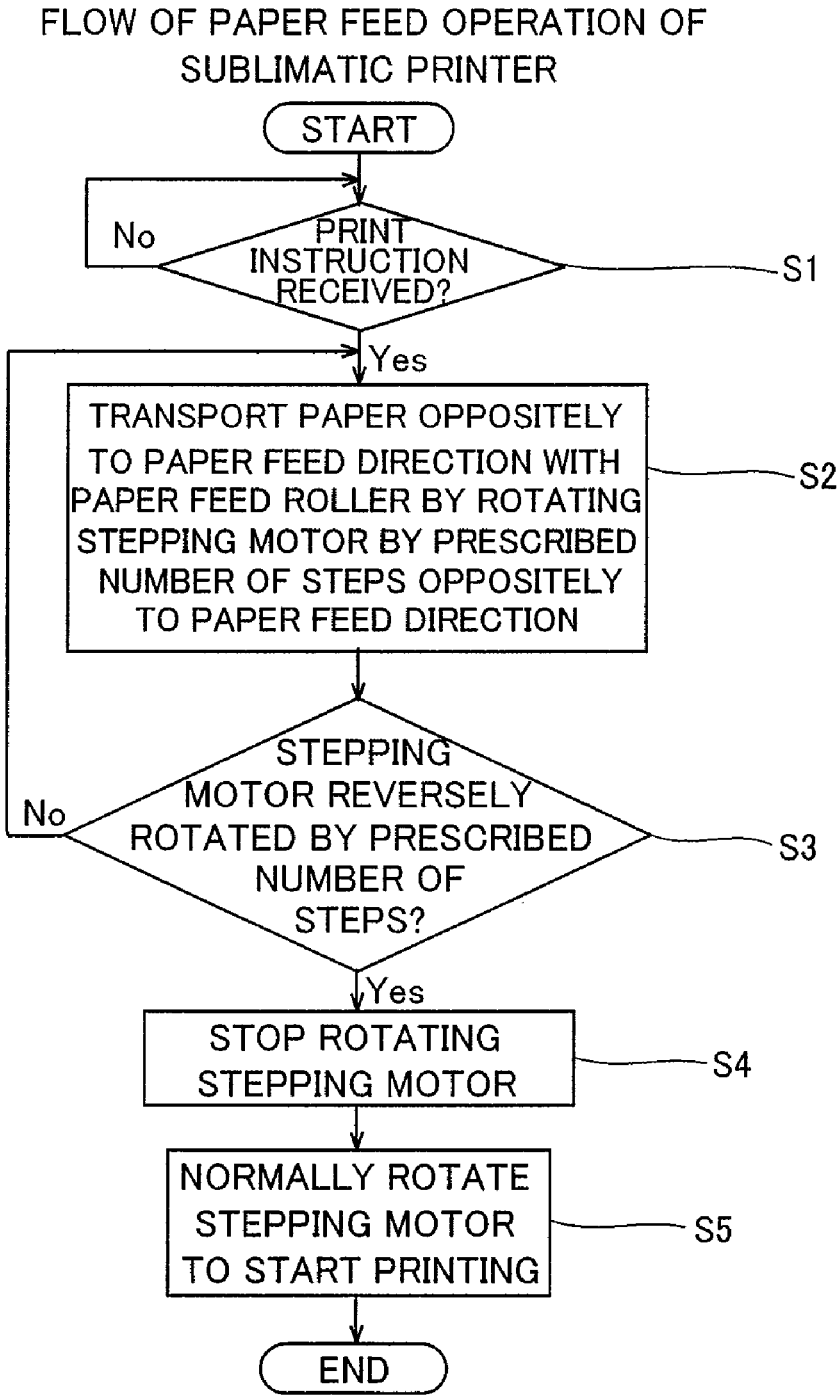
FIG. 10 is a flow chart for illustrating a paper feed operation of the sublimatic printer according to the embodiment shown in FIG. 1.

As shown in FIG. 10, the control portion 31 determines whether or not a print instruction has been received in the sublimatic printer 10 at a step S1. When determining that the print instruction has been received at the step S1, the control portion 31 advances to a step S2.

Figure 11:
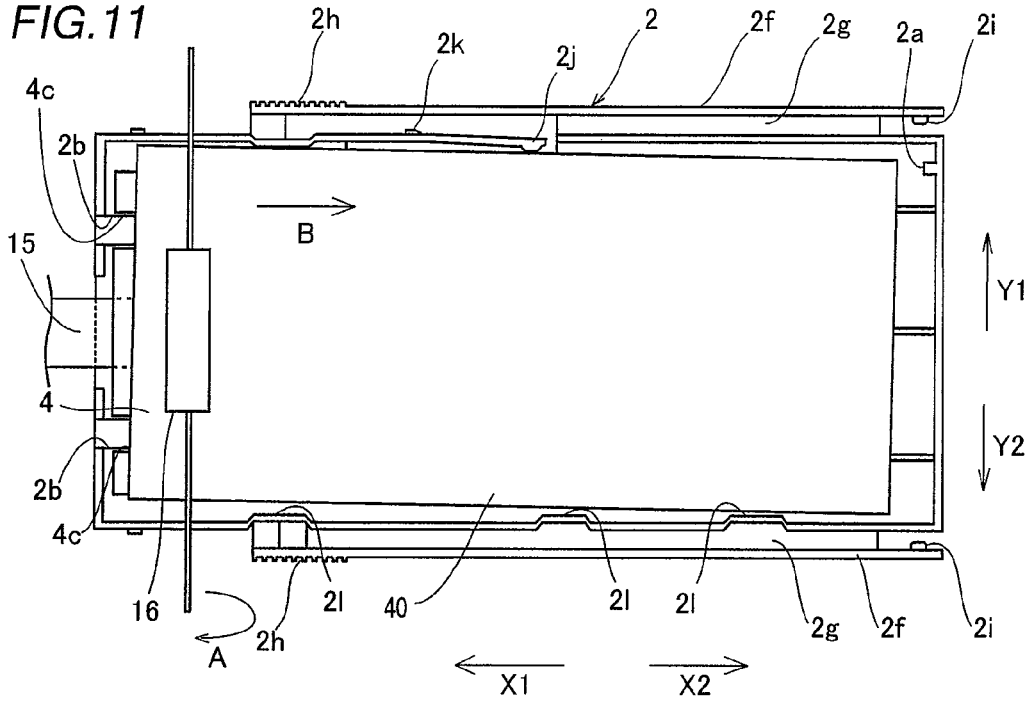
FIGS. 11 to 13 are diagrams for illustrating the paper feed operation on the paper tray according to the embodiment shown in FIG. 1.
Figure 12:
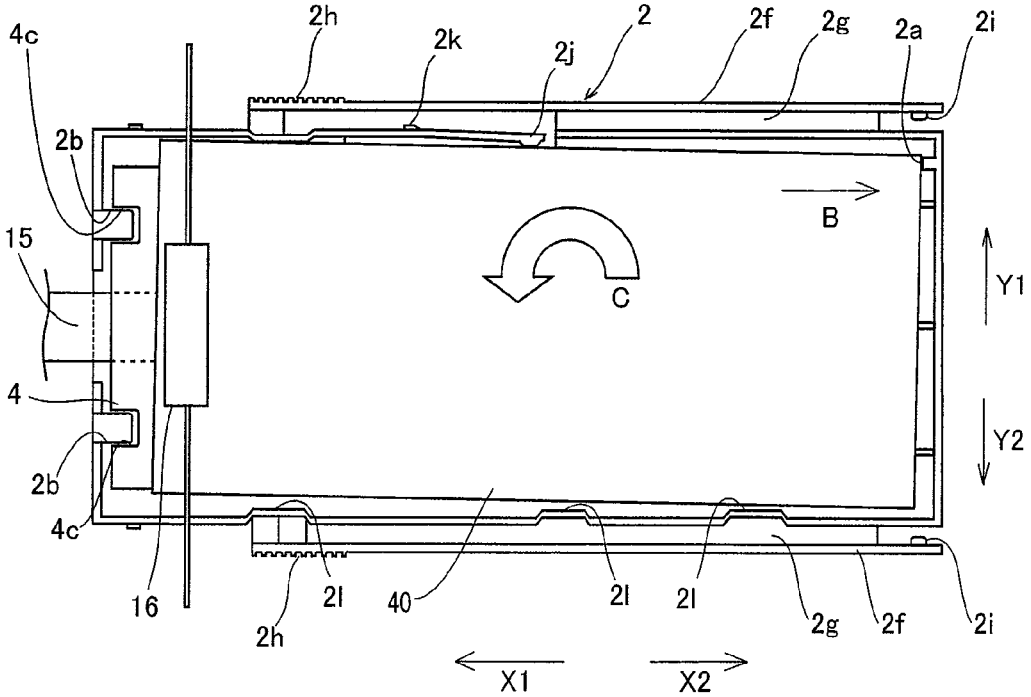

According to this embodiment, the control portion 31 so controls the motor controller 32 as to rotate the stepping motor 28 by a prescribed number of steps so that the paper feed roller 16 transports the papers 40 in the direction (along arrow X2 (see FIG. 1)) opposite to the paper feed direction. Thus, the stepping motor 28 rotates the paper feed roller 16 along arrow A for transporting the papers 40 gripped by the paper feed roller 16 along arrow B, as shown in FIG. 11. Also when the rear ends of the papers 40 come into contact with the rear-end rib 2*a* of the paper tray 2 as shown in FIG. 12, the stepping motor 28 further rotates the paper feed roller 16 to transport the papers 40 along arrow X2, whereby the papers 40 are supplied with torque along arrow C around the rear-end rib 2*a*. Consequently, the papers 40 are urged toward the paper regulating portions 21.

When determining that no print instruction has been received at the step S1, on the other hand, the control portion 31 repeats the determination until detecting the print instruction.

Figure 13:
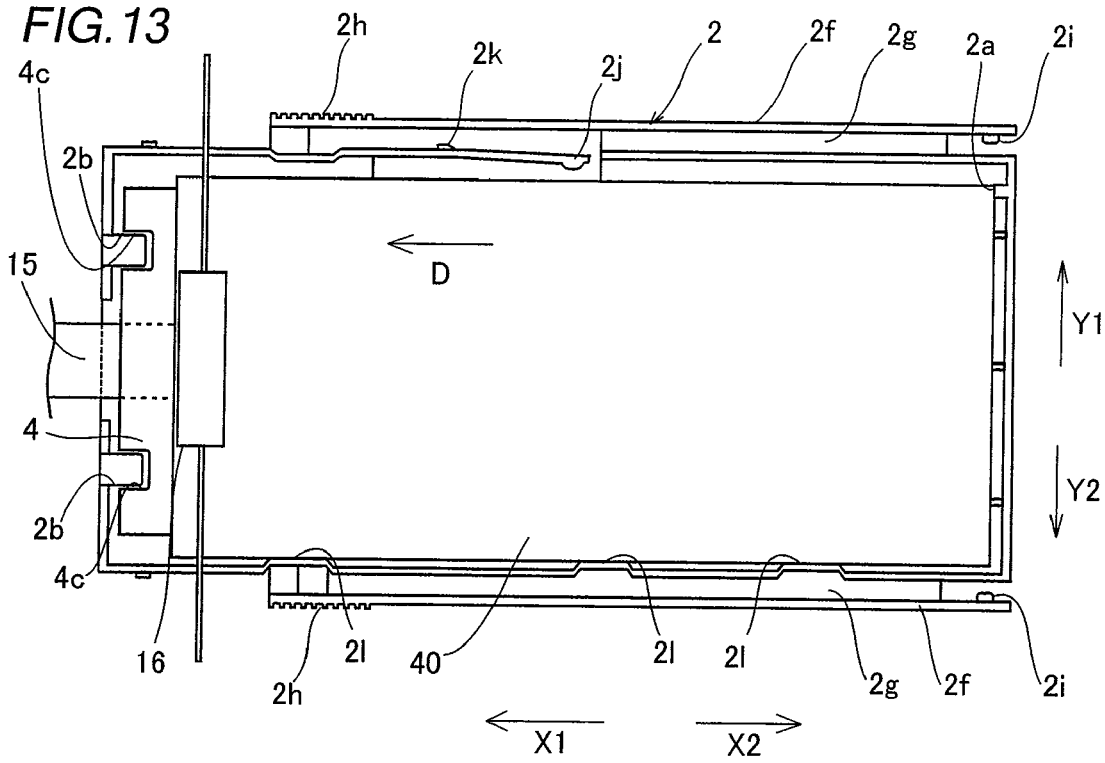

At a step S3, the control portion 31 determines whether or not the stepping motor 28 has been rotated by the prescribed number of steps for moving the papers 40 along arrow X2 (see FIG. 2) by a prescribed distance through the motor controller 32. When determining that the stepping motor 28 has been rotated by the prescribed number of steps at the step S3, the control portion 31 advances to the step S4 and controls the motor controller 32 to stop rotating the stepping motor 28. When determining that the stepping motor 28 has not been rotated by the prescribed number of steps at the step S3, on the other hand, the control portion 31 returns to the step S2 and controls the motor controller 32 to rotate the stepping motor 28 by the prescribed number of steps. After stopping rotating the stepping motor 28 at the step S4, the control portion 31 rotates the stepping motor 28 so that the paper feed roller 16 transports the papers 40 in the paper feed direction (along arrow X1 (see FIG. 1)) at a step S5. At this time, the paper regulating portions 21 substantially parallel to the paper feed direction regulate the positions of the papers 40 along arrows Y1 and Y2 while the papers 40 are transported along arrow D as shown in FIG. 13, whereby the papers 40 can be fed to the printer body 11 in an unskewed manner. Thus, the control portion 31 terminates the paper feed operation.

According to this embodiment, as hereinabove described, the rear-end rib 2*a* is provided on the portion of the inner wall surface of the paper tray 2 along arrow X2 in the vicinity of the corner where the side surface of the paper tray 2 along arrow Y1 and the side surface along arrow X2 (rear side) intersect with each other to protrude toward the rear ends of the papers 40 so that the paper feed roller 16 transports the papers 40 in the direction (along arrow X2) opposite to the paper feed direction (along arrow X1) in paper feeding and the rear ends of the papers 40 come into contact with the rear-end rib 2*a* to be supplied with the torque around the rear-end rib 2*a*, whereby the papers 40 are urged toward the paper regulating portions 21 provided substantially parallelly to the paper feed direction (along arrow X1) due to the torque applied thereto. Consequently, the paper regulating portions 21 regulate the positions of the fed papers 40 along arrows Y1 and Y2, whereby the papers 40 can be fed to the printer body 11 in an unskewed manner. The rear-end rib 2*a* is provided on the inner wall surface of the paper tray 2 along arrow X2 in the vicinity of the corner where the side surface along arrow Y1 and the side surface along arrow X2 (rear side) intersect with each other so that a larger radius of rotation can be ensured when the papers 40 are supplied with the torque, whereby the papers 40 can be more strongly urged toward the paper regulating portions 21. Consequently, skew of the papers 40 can be more reliably suppressed when transported along arrow X1 in the subsequent paper feed operation.

According to this embodiment, as hereinabove described, the rear-end rib 2*a* is integrally formed on the inner wall surface of the paper tray 2 along arrow X2, whereby increase in the number of components can be suppressed as compared with a case where a rib is separately provided on the inner wall surface of the paper tray 2 along arrow X2.

According to this embodiment, as hereinabove described, the control portion 31 is so formed as to control the stepping motor 28 for transporting the papers 40 in the direction (along arrow X2) opposite to the paper feed direction with the paper feed roller 16 and bringing the rear ends of the papers 40 into contact with the rear-end rib 2*a* thereby generating the torque for the papers 40 and thereafter transporting the papers 40 in the paper feed direction (along arrow X1) in paper feeding so that the papers 40 are urged toward the paper regulating portions 21 substantially parallel to the paper feed direction to be transported in the paper feed direction after the paper regulating portions 21 regulate the positions of the papers 40 along arrows Y1 and Y2, whereby the papers 40 can be fed to the printer body 11 in an unskewed manner.

According to this embodiment, as hereinabove described, the paper pressing portion 2*j* is integrally provided on the inner side surface of the paper tray 2 along arrow Y1 for pressing the side surfaces of the papers 40 along arrow Y1 thereby urging the papers 40 toward the paper regulating portions 21 of the paper tray 2 when the paper tray 2 stores the papers 40 so that the paper pressing portion 2*j* can urge the papers 40 toward the paper regulating portions 21 of the paper tray 2 by pressing the side surfaces of the papers 40 along arrow Y1 when the paper tray 2 stores the papers 40, whereby the effect of suppressing skew of the papers 40 can be further improved. Further, the paper pressing portion 2*j* is so integrally provided on the inner side surface of the paper tray 2 along arrow Y1 that increase in the number of components can be suppressed despite the paper pressing portion 2*j*.

According to this embodiment, as hereinabove described, the paper pressing portion 2*j* is switched between the pressing state pressing the side surfaces of the papers 40 along arrow Y1 and the nonpressing state not pressing the side surfaces of the papers 40 along arrow Y1 and so formed as to enter the pressing state when the papers 40 are transported along arrow X2 so that the paper pressing portion 2*j* reliably urges the papers 40 toward the paper regulating portions 21 of the paper tray 2 when the sublimatic printer 10 performs the paper feed operation of transporting the papers 40 along arrow X2, whereby the effect of suppressing skew of the papers 40 can be easily improved.

According to this embodiment, as hereinabove described, the three paper regulating portions 21 protruding from the inner wall surface of the paper tray 2 along arrow Y2 toward the direction along arrow Y1 are integrally provided on the separate positions respectively so that frictional force applied to the side surfaces of the papers 40 along arrow Y2 can be reduced as compared with a case where a single paper regulating portion is provided on the inner wall surface of the paper tray 2 along arrow Y2 to extend along arrows X1 and X2 when the papers 40 are transported while the side surfaces along arrow Y2 are in contact with the paper regulating portions 21, whereby the papers 40 can be more smoothly transported. Further, the paper regulating portions 21 are so integrally provided on the inner wall surface of the paper tray 2 along arrow Y2 that increase in the number of components can be suppressed as compared with a case where the paper regulating portions 21 are provided independently of the paper tray 2.

According to this embodiment, as hereinabove described, the rear-end rib 2*a* is so formed as to extend from the lower end to the upper end of the inner wall surface of the paper tray 2 including the rear-side inner wall surface so that the papers 40 transported along arrow X2 can be brought into contact with the rear-end rib 2*a* regardless of the vertical position (number) of the transported papers 40, whereby skew of the papers 40 can be more reliably suppressed.

Although the present invention has been described and illustrated in detail, it is clearly understood that the same is by way of illustration and example only and is not to be taken by way of limitation, the spirit and scope of the present invention being limited only by the terms of the appended claims.

While the aforementioned embodiment is applied to the sublimatic printer employed as an exemplary apparatus comprising the paper feed mechanism, the present invention is not restricted to this but is also applicable to an image generating apparatus such as a copying machine or a facsimile transmitter/receiver other than the sublimatic printer.

Figure 14:
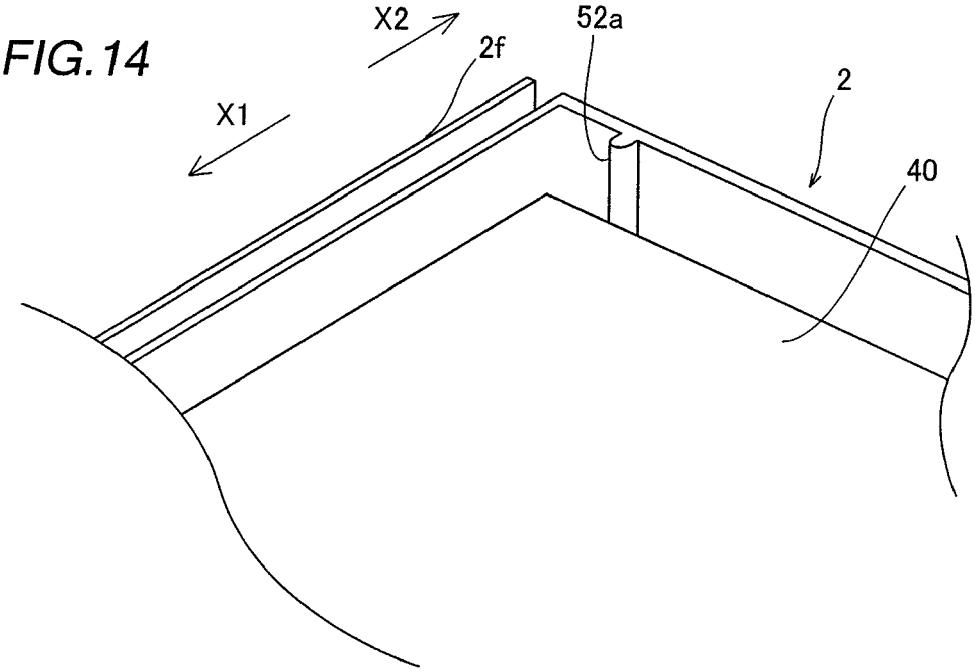
FIG. 14 is an enlarged perspective view of a portion around a rear-end rib according to a modification of the embodiment shown in FIG. 4.

While the rear-end rib of the paper feed cassette of the apparatus comprising the paper feed mechanism is in the form of a rectangular parallelepiped in the aforementioned embodiment, the present invention is not restricted to this but a rear-end rib having another shape may alternatively be provided. For example, a rear-end rib 52*a* may have a rounded surface coming into contact with the papers 40, as shown in FIG. 14. According to the structure of this modification, the papers 40 come into contact with the rounded surface (along arrow X1) of the rear-end rib 52*a* to be rotated when transported along arrow X2, whereby the papers 40 are more smoothly rotated. Thus, the papers 40 can be reliably urged toward the paper regulating portions 21 (see FIG. 13).

What is claimed is:

1. A paper feed mechanism comprising:

a paper feed cassette storing a paper; and an apparatus body mountable with said paper feed cassette, wherein said apparatus body includes a paper feed roller, a driving portion rotating said paper feed roller in a first direction for feeding said paper and a second direction opposite to said first direction and a control portion controlling said driving portion, said paper feed cassette includes a paper storage portion receiving said paper and said paper storage portion has a paper contact portion integrally formed on a position of a rear-side inner wall surface deviating from the center in the cross direction of said paper by a prescribed distance in the cross direction of said paper, and said control portion is so formed as to control said driving portion for transporting said paper in said second direction with said paper feed roller, bringing the rear end of said paper into contact with said paper contact portion thereby generating torque for said paper, and thereafter transporting said paper in said first direction with said paper feed roller in paper feeding.

2. The paper feed mechanism according to claim 1, wherein said paper contact portion of said paper feed cassette includes a rib portion so formed as to protrude from said rear-side inner wall surface of said paper storage portion toward the rear end of said paper.

3. The paper feed mechanism according to claim 1, wherein said paper feed cassette further includes a regulating portion provided on a second inner side surface of said paper storage portion opposed to a first inner side surface of said paper storage portion substantially parallelly to said first direction for regulating a first side surface of said paper, and said paper contact portion is arranged closer to said first inner side surface of said paper storage portion with respect to the center of said rear-side inner wall surface in the cross direction of said paper.

4. The paper feed mechanism according to claim 3, wherein said paper contact portion of said paper feed cassette is arranged on said rear-side inner wall surface in the vicinity of a corner constituted of the rear end and said first inner side surface of said paper storage portion.

5. The paper feed mechanism according to claim 3, wherein a plurality of said regulating portions are provided on said paper feed cassette to protrude from said second inner side surface toward said first inner side surface of said paper storage portion and integrally formed on said second inner side surface of said paper storage portion.

6. The paper feed mechanism according to claim 1, wherein said paper feed cassette further includes a pressing portion integrally formed on said first inner side surface of said paper storage portion for pressing a second side surface of said paper thereby urging said paper toward a second inner side surface of said paper feed cassette when said paper feed cassette stores said paper.

7. The paper feed mechanism according to claim 6, wherein said pressing portion of said paper feed cassette is switched between a pressing state pressing said second side surface of said paper and a nonpressing state not pressing said second side surface of said paper, and switched to said pressing state when said paper is transported in said second direction.

8. The paper feed mechanism according to claim 1, wherein said paper contact portion of said paper feed cassette is so formed as to extend from the lower end to the upper end of said rear-side inner wall surface of said paper storage portion.

9. The paper feed mechanism according to claim 1, wherein a surface of said paper contact portion of said paper feed cassette coming into contact with said paper is rounded.

10. An image generating apparatus comprising:

a paper feed cassette storing a paper; and an apparatus body, mountable with said paper feed cassette, including a print portion, wherein said apparatus body includes a paper feed roller, a driving portion rotating said paper feed roller in a first direction for feeding said paper and a second direction opposite to said first direction and a control portion controlling said driving portion, said paper feed cassette includes a paper storage portion receiving said paper and said paper storage portion has a paper contact portion integrally formed on a position of a rear-side inner wall surface deviating from the center in the cross direction of said paper by a prescribed distance in the cross direction of said paper, and said control portion is so formed as to control said driving portion for transporting said paper in said second direction with said paper feed roller, bringing the rear end of said paper into contact with said paper contact portion thereby generating torque for said paper, and thereafter transporting said paper in said first direction with said paper feed roller in paper feeding.

11. The image generating apparatus according to claim 10, wherein said paper contact portion of said paper feed cassette includes a rib portion so formed as to protrude from said rear-side inner wall surface of said paper storage portion toward the rear end of said paper.

12. The image generating apparatus according to claim 10, wherein said paper feed cassette further includes a regulating portion provided on a second inner side surface of said paper storage portion opposed to a first inner side surface of said paper storage portion substantially parallelly to said first direction for regulating a first side surface of said paper, and said paper contact portion is arranged closer to said first inner side surface of said paper storage portion with respect to the center of said rear-side inner wall surface in the cross direction of said paper.

13. The image generating apparatus according to claim 12, wherein said paper contact portion of said paper feed cassette is arranged on said rear-side inner wall surface in the vicinity of a corner constituted of the rear end and said first inner side surface of said paper storage portion.

14. The image generating apparatus according to claim 12, wherein a plurality of said regulating portions are provided on said paper feed cassette to protrude from said second inner side surface toward said first inner side surface of said paper storage portion and integrally formed on said second inner side surface of said paper storage portion.

15. The image generating apparatus according to claim 10, wherein said paper feed cassette further includes a pressing portion integrally formed on said first inner side surface of said paper storage portion for pressing a second side surface of said paper thereby urging said paper toward a second inner side surface of said paper feed cassette when said paper feed cassette stores said paper.

16. The image generating apparatus according to claim 15, wherein said pressing portion of said paper feed cassette is switched between a pressing state pressing said second side surface of said paper and a nonpressing state not pressing said second side surface of said paper, and switched to said pressing state when said paper is transported in said second direction.

17. The image generating apparatus according to claim 10, wherein said paper contact portion of said paper feed cassette is so formed as to extend from the lower end to the upper end of said rear-side inner wall surface of said paper storage portion.

18. The image generating apparatus according to claim 10, wherein a surface of said paper contact portion of said paper feed cassette coming into contact with said paper is rounded.

* * * * *